US009929489B2

(12) United States Patent
Nagashima

(10) Patent No.: US 9,929,489 B2
(45) Date of Patent: Mar. 27, 2018

(54) CONNECTOR

(71) Applicant: Yazaki Corporation, Tokyo (JP)

(72) Inventor: Daisuke Nagashima, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/605,305

(22) Filed: May 25, 2017

(65) Prior Publication Data

US 2017/0346210 A1 Nov. 30, 2017

(30) Foreign Application Priority Data

May 31, 2016 (JP) ..... 2016-108976

(51) Int. Cl.

| | |
|---|---|
| ***H01R 13/64*** | (2006.01) |
| ***H01R 13/08*** | (2006.01) |
| ***H01R 24/28*** | (2011.01) |
| *H01R 105/00* | (2006.01) |

(52) U.S. Cl.

CPC ..... *H01R 13/08* (2013.01); *H01R 24/28* (2013.01); *H01R 2105/00* (2013.01); *H01R 2201/26* (2013.01)

(58) Field of Classification Search

CPC ..... H01R 13/08; H01R 24/28; H01R 2105/00
USPC ..... 439/668, 34, 188, 845, 848–850, 246
See application file for complete search history.

(56) References Cited

U.S. PATENT DOCUMENTS 6,325,633 B1 * 12/2001 Ito ..... H01R 13/187 439/246
6,332,781 B1 * 12/2001 Ito ..... H01R 13/187 439/138
6,609,920 B2 * 8/2003 Koyasu ..... H01R 13/08 439/188
2002/0173189 A1 * 11/2002 Koyasu ..... H01H 23/006 439/188

FOREIGN PATENT DOCUMENTS

JP 2003-208943 A 7/2003

* cited by examiner

*Primary Examiner* — Tulsidas C Patel
*Assistant Examiner* — Travis Chambers
(74) *Attorney, Agent, or Firm* — Sughrue Mion, PLLC

(57) ABSTRACT

A connector includes a connector main body having a wall portion and a shaft portion protruding from the wall portion; a pair of terminals which is relatively rotatable around the shaft portion and interposes a terminal of a counterpart connector; a torsion spring which has a coil, and a pair of arms protruding outward in a radial direction from the coil, is disposed between the pair of terminals in a state in which the shaft portion is inserted through the coil, and urges the pair of terminals in a rotational direction by the pair of arms; and guide portions which are provided in the connector main body, abut against the pair of arms when the torsion spring is pushed toward a proximal end side of the shaft portion, and guides the torsion spring between the pair of terminals, while elastically deforming the torsion spring.

8 Claims, 13 Drawing Sheets

CONNECTOR

CROSS-REFERENCE TO RELATED APPLICATION(S)

The present application claims priority to and incorporates by reference the entire contents of Japanese Patent Application No. 2016-108976 filed in Japan on May 31, 2016.

BACKGROUND OF THE INVENTION

1. Field of the Invention

The present invention relates to a connector.

2. Description of the Related Art

Conventionally, there has been a connector having a pair of terminals that interposes a terminal of a counterpart connector by an urging force of a torsion spring. For example, Japanese Patent Application Laid-open No. 2003-208943 discloses, as an example of a terminal of such a connector, a technique of a terminal fitting which includes an electric contact section connected to a counterpart terminal fitting, and in which the electric contact section includes a pair of contactors which is urged in a direction of coming close to each other, and interposes a counterpart terminal fitting therebetween.

Here, when assembling the torsion spring, it is necessary to insert the torsion spring between the pair of terminals, while torsionally deforming the torsion spring, which is accompanied with difficulty. It is desired to be able to improve the efficiency of assembling work of the torsion spring.

SUMMARY OF THE INVENTION

An object of the present invention is to provide a connector capable of improving assembling workability of a torsion spring.

A connector according to one aspect of the present invention includes a connector main body having a wall portion and a shaft portion protruding from the wall portion; a pair of terminals which is relatively rotatable about the shaft portion and interposes a counterpart terminal; a torsion spring which has a coil, and a pair of arms protruding outward in a radial direction from the coil, is disposed between the pair of terminals in a state in which the shaft portion is inserted through the coil, and urges the pair of terminals in a rotational direction by the pair of arms; and a guide portion which is provided in the connector main body, abuts against the pair of arms when the torsion spring is pushed toward a proximal end side of the shaft portion, and guides the torsion spring between the pair of terminals, while elastically deforming the torsion spring.

According to another aspect of the present invention, in the connector, it is preferable that the guide portion has a pair of guide surfaces which faces each other and is inclined, when the torsion spring is pushed toward the proximal end side of the shaft portion, the pair of arms is guided by abutting against each of the pair of guide surfaces, and an interval between the pair of guide surfaces becomes narrower toward the proximal end side of the shaft portion.

According to still another aspect of the present invention, in the connector, it is preferable that a plurality of the pairs of terminals is disposed on the connector main body, the connector main body has a partition wall portion which partitions between one pair of the terminals and the other pair of the terminals, and the guide portion is a protrusion provided on the partition wall portion.

According to still another aspect of the present invention, it is preferable that the connector further includes a case assembled to the connector main body from a distal end side of the shaft portion, wherein the case has a pressing portion which abuts against the torsion spring to press the torsion spring toward the proximal end side of the shaft portion.

According to still another aspect of the present invention, in the connector, it is preferable that the pressing portion is fitted to the shaft portion, and holds the torsion spring between the pressing portion and the wall portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to an embodiment of the present invention will be described in detail with reference to the drawings. The present invention is not limited by this embodiment. In addition, constituent elements in the following embodiments include those that can be easily assumed by those skilled in the art or substantially the same.

Embodiment

Figure 1:
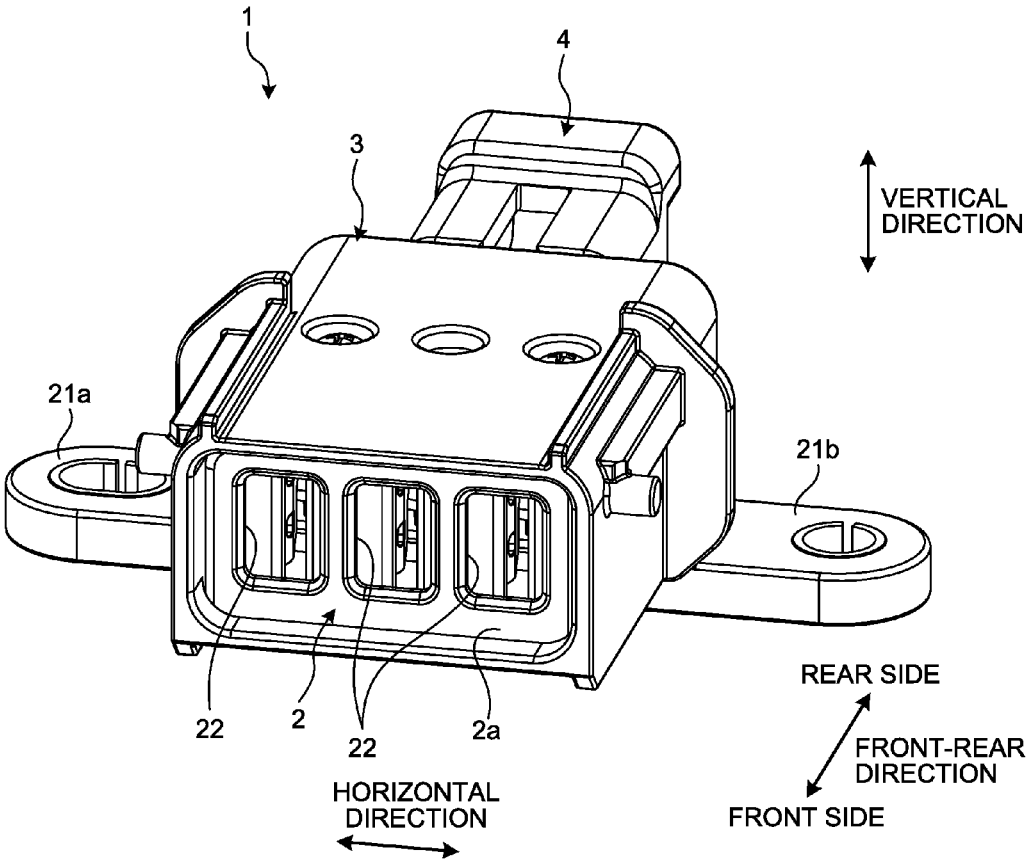
FIG. 1 is a perspective view illustrating a connector according to an embodiment.
Figure 2:
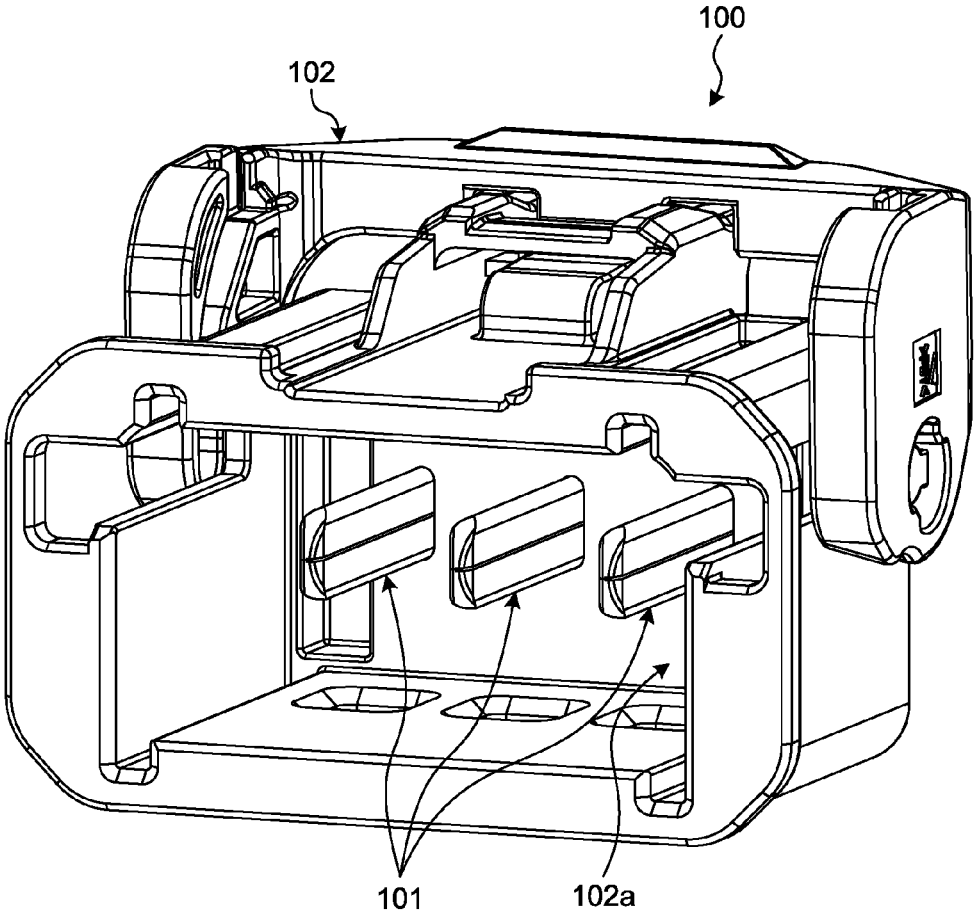
FIG. 2 is a perspective view illustrating an example of a counterpart connector.
Figure 3:
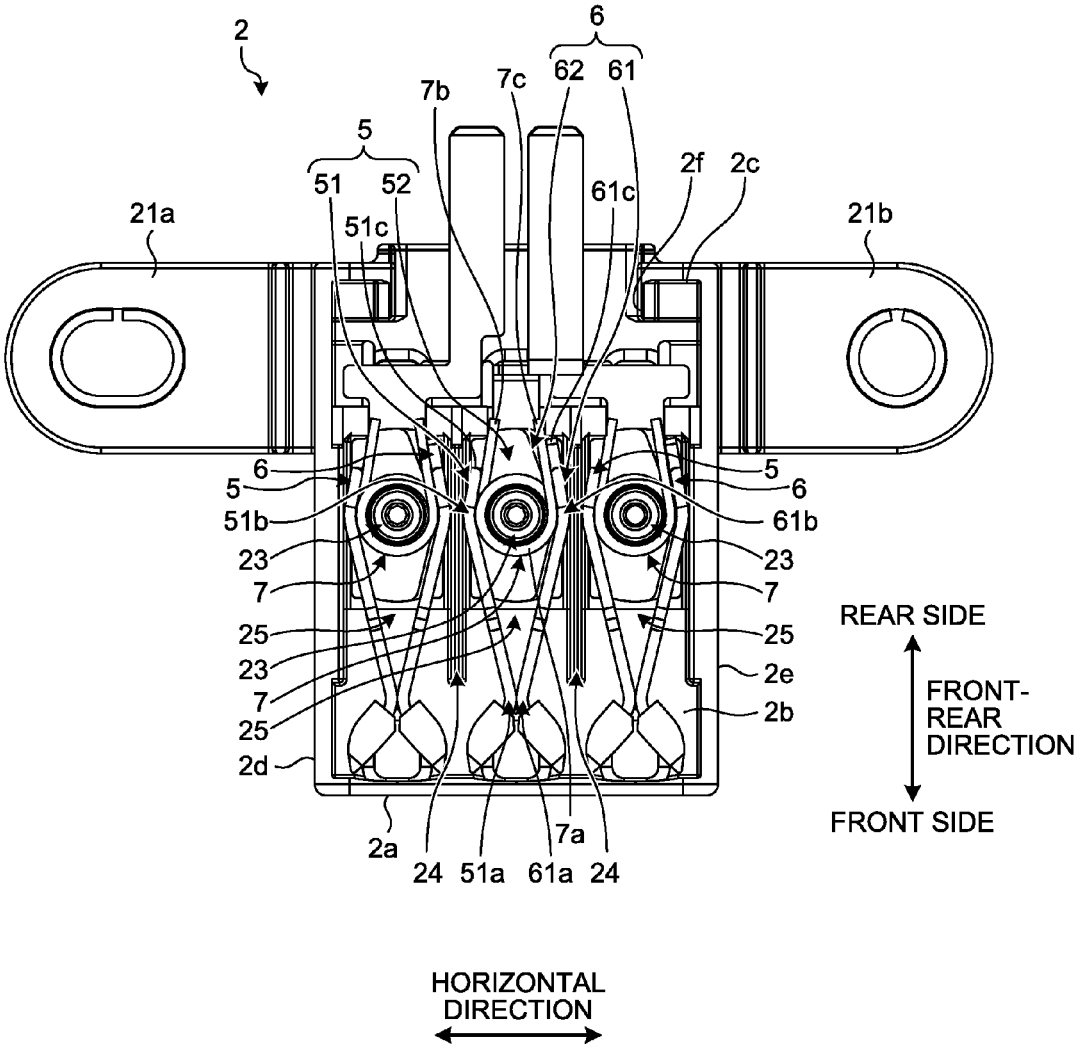
FIG. 3 is a plan view illustrating the inside of the connector according to the embodiment.
Figure 4:
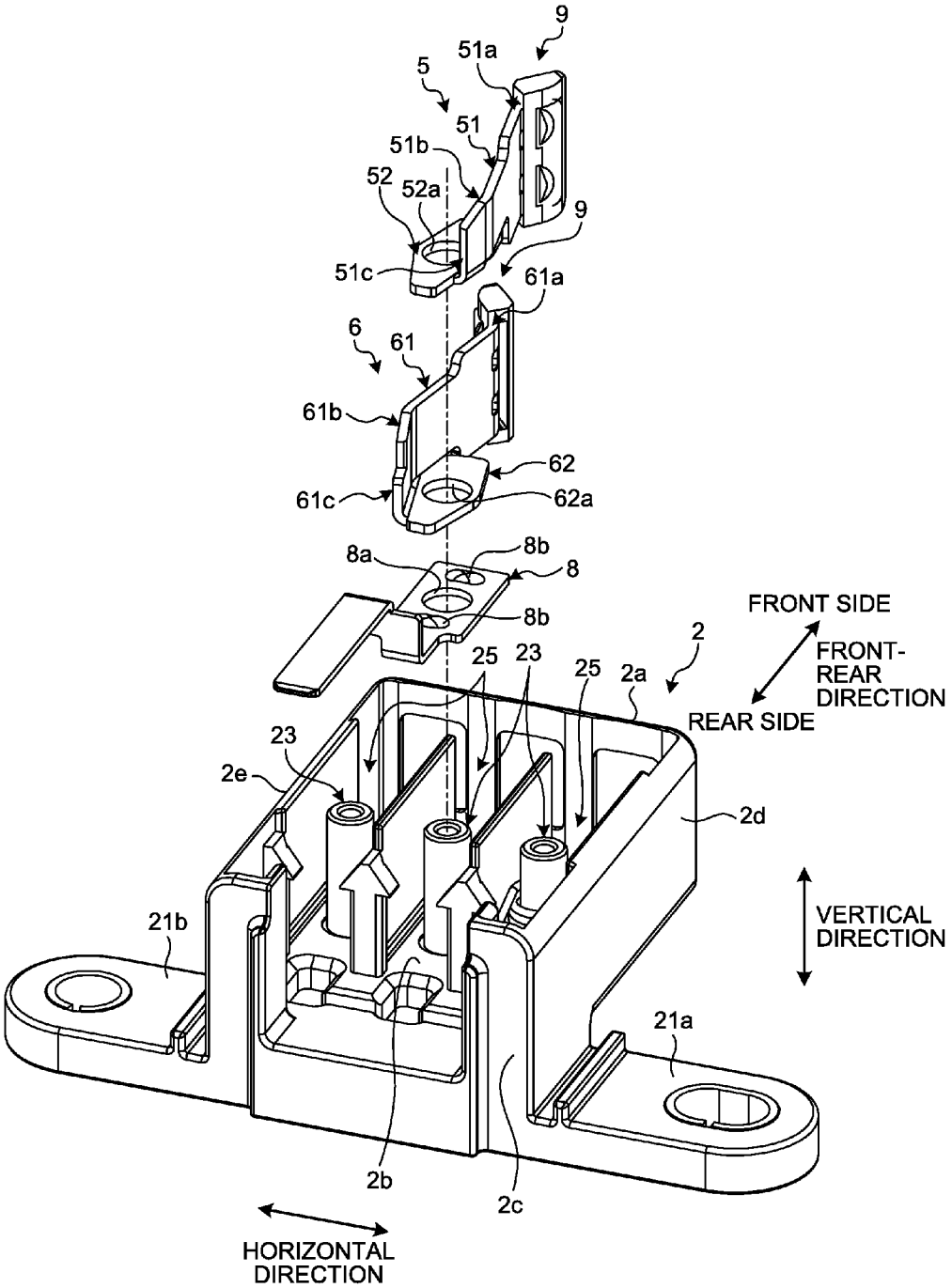
FIG. 4 is an exploded perspective view of a connector according to the embodiment.
Figure 5:
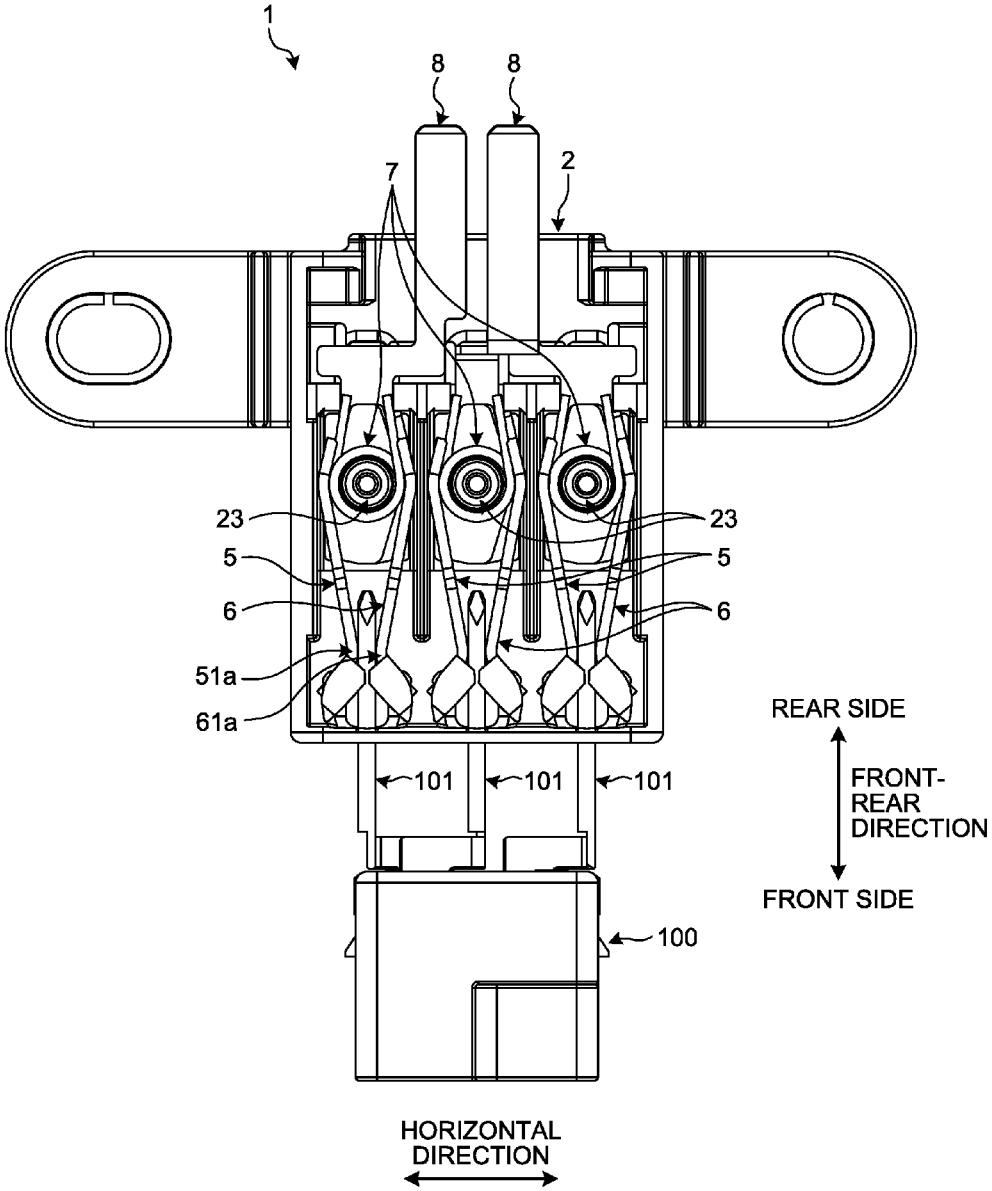
FIG. 5 is an internal plan view illustrating a state of connection of the connector of the embodiment with a counterpart connector.

Embodiments will be described with reference to FIGS. 1 to 13. This embodiment relates to a connector. FIG. 1 is a perspective view illustrating a connector according to an embodiment, FIG. 2 is a perspective view illustrating an example of a counterpart connector, FIG. 3 is a plan view illustrating the inside of the connector according to the embodiment, FIG. 4 is an exploded perspective view of a connector according to the embodiment, and FIG. 5 is an internal plan view illustrating a state of connection of the connector of the embodiment with a counterpart connector.

The connector 1 illustrated in FIG. 1 is a female connector. The connector 1 is connected to a counterpart connector 100 illustrated in FIG. 2. The connector 1 and the counterpart connector 100 are used, for example, as a power supply connecting device in a back door of a vehicle. As an example, the connector 1 of this embodiment is disposed on the vehicle side, and the counterpart connector 100 is disposed on the back door. By the opening and closing operation of the back door, a tab 101 of the counterpart connector 100 is inserted into and extracted from the connector 1. When the tab 101 is inserted into the connector 1, terminals 5 and 6 to be described later of the connector 1 are electrically connected to the tab 101. Further, the connector 1 and the counterpart connector 100 may be used as a power supply connecting device of a detachable seat of the vehicle.

As illustrated in FIG. 1, the connector 1 has a connector main body 2, a case 3, and a housing 4. The connector 1 further includes terminals 5 and 6, and a torsion spring 7 to be described later. The connector main body 2 is a casing which stores the terminals 5 and 6, the torsion spring 7 and the like. The case 3 is a cover that covers an opening of the connector main body 2 to form a closed space. The housing 4 surrounds a bus bar 8 protruding from the connector main body 2, and functions as a fitting portion to be engaged with a connector on a power supply side.

The connector main body 2 has an opening 22 into which the tab 101 of the counterpart connector 100 is inserted. The connector main body 2 has a pair of fixing portions 21*a* and 21*b* protruding toward the side. The fixing portions 21*a* and 21*b* are portions fixed to a vehicle body or the like. The fixing portions 21*a* and 21*b* protrude in a direction orthogonal to a front-rear direction. In the connector 1, a direction in which the counterpart connector 100 is inserted and extracted is referred to as a "front-rear direction", and a direction in which the fixing portions 21*a* and 21*b* protrude is referred to as a "horizontal direction". Further, in the connector 1, a direction orthogonal to the front-rear direction and the horizontal direction is referred to as a "vertical direction". The fixing portion 21*a* protrudes toward one side in the horizontal direction, and the fixing portion 21*b* protrudes toward the other side in the horizontal direction. The opening 22 is formed in a wall portion 2*a* of the connector main body 2 on one side in the front-rear direction (hereinafter, referred to as a "front side wall portion"). In the following description, in the connector 1, a side connected to the counterpart connector 100 in the front-rear direction will be referred to as a "front side", and a side opposite to the front side will be referred to as a "rear side".

Three openings 22 are arranged side by side on the front side wall portion 2*a* in the horizontal direction. A pair of terminals 5 and 6 is disposed in the connector main body 2 so as to correspond to one opening 22. As illustrated in FIG. 3, the connector main body 2 has a bottom wall portion 2*b*, a rear side wall portion 2*c*, and a pair of side wall portions 2*d* and 2*e*, in addition to the front side wall portion 2*a*. Each of the wall portions 2*a*, 2*b*, 2*c*, 2*d* and 2*e* is integrally molded by a synthetic resin. The bottom wall portion 2*b* is a rectangular plate-like component. The front side wall portion 2*a* protrudes in the horizontal direction from the front end of the bottom wall portion 2*b*. The rear side wall portion 2*c* protrudes in the horizontal direction from a portion near the rear end of the bottom wall portion 2*b*. A notch 2*f* corresponding to the housing 4 is provided on the rear side wall portion 2*c*. In the connector main body 2, a portion facing the bottom wall portion 2*b* is an opening. The housing 4 is fixed to the connector main body 2 in a state of protruding rearward from the notch 2*f*.

The first side wall portion 2*d* and the second side wall portion 2*e* protrude in the vertical direction from the end portion of the bottom wall portion 2*b* in the horizontal direction. More specifically, the first side wall portion 2*d* protrudes in the vertical direction from one end of the bottom wall portion 2*b* in the horizontal direction, and the second side wall portion 2*e* protrudes in the vertical direction from the other end of the bottom wall portion 2*b* in the horizontal direction. The side wall portions 2*d* and 2*e* face each other in the horizontal direction with the bottom wall portion 2*b* interposed therebetween. Further, the wall portions 2*a*, 2*c*, 2*d* and 2*e* and the bottom wall portion 2*b* form a storage space which stores the terminals 5 and 6 and the like. The connector main body 2 has a shaft portion 23 that protrudes in the vertical direction from the bottom wall portion 2*b*. The shaft portion 23 is a cylindrical component and is orthogonal to the bottom wall portion 2*b*. The shaft portion 23 is disposed at the center of the bottom wall portion 2*b* in the front-rear direction. In the connector main body 2 of the present embodiment, three shaft portions 23 are disposed along the horizontal direction.

A partition wall portion 24 is disposed between the adjacent shaft portions 23. The partition wall portion 24 is a flat plate-like wall portion which is formed integrally with the bottom wall portion 2*b* and protrudes in the vertical direction from the bottom wall portion 2*b*. The partition wall portion 24 partitions the pair of terminals 5 and 6, and the other pair of terminals 5 and 6. In the connector main body 2, a terminal storage portion 25 is formed by a pair of side wall portions 2*d* and 2*e* and a pair of partition wall portions 24. A pair of terminals 5 and 6 is disposed in each terminal storage portion 25. The connector main body 2 has three terminal storage portions 25. A pair of terminals 5 and 6 is stored in each terminal storage portion 25. Among the three pairs of terminals 5 and 6, a pair is connected to a ground line, and other two pairs are connected to a power supply.

The first terminal 5 and the second terminal 6 are terminals electrically connected to the tab 101 of the counterpart connector 100. The terminals 5 and 6 are supported so as to be relatively rotatable around the shaft portion 23. As illustrated in FIGS. 3 and 4, the first terminal 5 has a plate-like main body 51 bent in a substantially S shape, and a support portion 52. The main body 51 and the support portion 52 are formed of a metal or the like having conductivity. The first terminal 5 is formed, for example, by machining a single metal plate by pressing or the like. The main body 51 has a first bent portion 51*a* that is bent to protrude toward one side in a plate thickness direction, and a second bent portion 51*b* that is bent to protrude toward the other side in the plate thickness direction. In the main body 51, the first bent portion 51*a* is provided on the front end side, and the second bent portion 51*b* is provided on the rear end side. The support portion 52 is bent so as to be orthogonal to the main body 51. The support portion 52 is connected to the rear end portion of the main body 51. The support portion 52 is provided with a through-hole 52*a*. A cover 9 is mounted to the front end of the main body 51. The cover 9 is an insulating member made of a synthetic resin or the like.

The second terminal 6 has a plate-like main body 61 and a support portion 62. The main body 61 has a first bent portion 61*a* that is bent to protrude toward one side in the plate thickness direction, and a second bent portion 61*b* that is bent to protrude toward the other side in the plate thickness direction. In the main body 61, the first bent portion 61*a* is provided on the front end side, and the second bent portion 61*b* is provided on the rear end side. The support portion 62 is bent so as to be orthogonal to the main body 61. The support portion 62 is connected to the rear end portion of the main body 61. The support portion 62 is provided with a through-hole 62*a*. The cover 9 is mounted to the front end of the main body 61.

The shape of the second terminal 6 is substantially plane-symmetrical with the shape of the first terminal 5. More specifically, as illustrated in FIG. 3, the main body 51 of the first terminal 5 in the plan view has an S shape in a state of being disposed in the terminal storage portion 25. Meanwhile, the main body 61 of the second terminal 6 in the plan view has an inverted S shape in a state of being disposed in the terminal storage portion 25. While the support portion 52 of the first terminal 5 is bent from the main body 51 toward one side in the horizontal direction, the support portion 62 of the second terminal 6 is bent from the main body 61 toward the other side in the horizontal direction.

The first terminal 5 and the second terminal 6 are disposed such that the first bent portion 51*a* and the first bent portion 61*a* face each other in the horizontal direction. The first bent portion 51*a* of the first terminal 5 protrudes toward the second terminal 6 side, and the first bent portion 61*a* of the second terminal 6 protrudes toward the first terminal 5 side. The pair of terminals 5 and 6 is electrically connected to the tab 101, while interposing the tab 101 of the counterpart connector 100 between the first bent portions 51*a* and 61*a*. The torsion spring 7 exerts a pressing force to the pair of terminals 5 and 6 in a direction of bringing the first bent portions 51*a* and 61*a* close to each other. More specifically, the torsion spring 7 is constituted by a single linear member having elasticity, and has a coil 7*a*, a first arm 7*b*, and a second arm 7*c*.

The coil 7*a* is a component wound in a spiral shape. The arms 7*b* and 7*c* are end portions of the linear member, and protrude outward in a radial direction from the coil 7*a*. In the torsion spring 7 of the present embodiment, the first arm 7*b* protrudes in a tangential direction from one end of the coil 7*a*, and the second arm 7*c* protrudes in the tangential direction from the other end of the coil 7*a*. The torsion spring 7 is configured such that the first arm 7*b* and the second arm 7*c* form an acute angle, for example, in a state in which no external force is applied. The shaft portion 23 is inserted through the coil 7*a* of the torsion spring 7. The torsion spring 7 is disposed between the first terminal 5 and the second terminal 6 in a posture in which the first arm 7*b* and the second arm 7*c* protrude rearward from the shaft portion 23. The first arm 7*b* presses an end portion (hereinafter referred to as a "rear end portion") 51*c* of the first terminal 5 on the second bent portion 51*b* side. The second arm 7*c* presses the end portion (hereinafter referred to as a "rear end portion") 61*c* of the second terminal 6 on the second bent portion 61*b* side. That is, the torsion spring 7 generates the urging force in the rotational direction which separates the rear end portions 51*c* and 61*c* of the terminals 5 and 6 from each other and bringing the first bent portions 51*a* and 61*a* close to each other.

The bus bar 8 is a connecting member having conductivity. The bus bar 8 connects the terminals 5 and 6 to a power supply or the like mounted on the vehicle. As illustrated in FIG. 4, the terminals 5 and 6 and the bus bar 8 have through-holes 52*a*, 62*a* and 8*a*, respectively. When the terminals 5 and 6 and the bus bar 8 are disposed in the terminal storage portion 25, the shaft portion 23 is inserted in the order of the through-holes 8*a*, 62*a* and 52*a* as illustrated in FIG. 4. Therefore, the bus bar 8 is supported by the bottom wall portion 2*b* of the connector main body 2, the second terminal 6 is supported by the bus bar 8, and the first terminal 5 is supported by the second terminal 6. The bus bar 8 has a protrusion 8*b* that slidably supports the support portion 62 of the second terminal 6. The shape of the protrusion 8*b* is an oval shape, and comes into line-contact or point-contact with the support portion 62. The protrusion 8*b* is an electrical contact point with the support portion 62. The first terminal 5 has a protrusion 52*b* (see FIG. 13) on the lower surface of the support portion 52. The protrusion 52*b* of the first terminal 5 is slidably supported by the support portion 62 of the second terminal 6. The protrusion 52*b* is an electrical contact point with the support portion 62. The torsion spring 7 is assembled after the shaft portion 23 is inserted into each of the through-holes 8*a*, 62*a* and 52*a*.

Returning to FIG. 2, the counterpart connector 100 has the tab 101 and a casing 102. The tab 101 is a terminal of the counterpart connector 100, and is made of a conductive metal or the like. The casing 102 has a concave fitting portion 102*a*. The tab 101 protrudes from the bottom of the fitting portion 102*a*. The fitting portion 102*a* is fitted to the front end portion of the connector 1 of the present embodiment. By the fitting, the tab 101 of the counterpart connector 100 is inserted into the opening 22 of the connector 1.

FIG. 5 illustrates the inside of the connector 1 engaged with the counterpart connector 100. As illustrated in FIG. 5, the pair of terminals 5 and 6 interposes the tab 101 of the counterpart connector 100 by the urging force of the torsion spring 7, and is electrically connected to the tab 101. More specifically, the pair of terminals 5 and 6 rotates relative to each other around the shaft portion 23, and interposes the tab 101 between the first bent portions 51*a* and 61*a*. The torsion spring 7 presses the first bent portions 51*a* and 61*a* toward the tab 101, and maintains the electrical connection state between the connector 1 and the counterpart connector 100.

Figure 6:
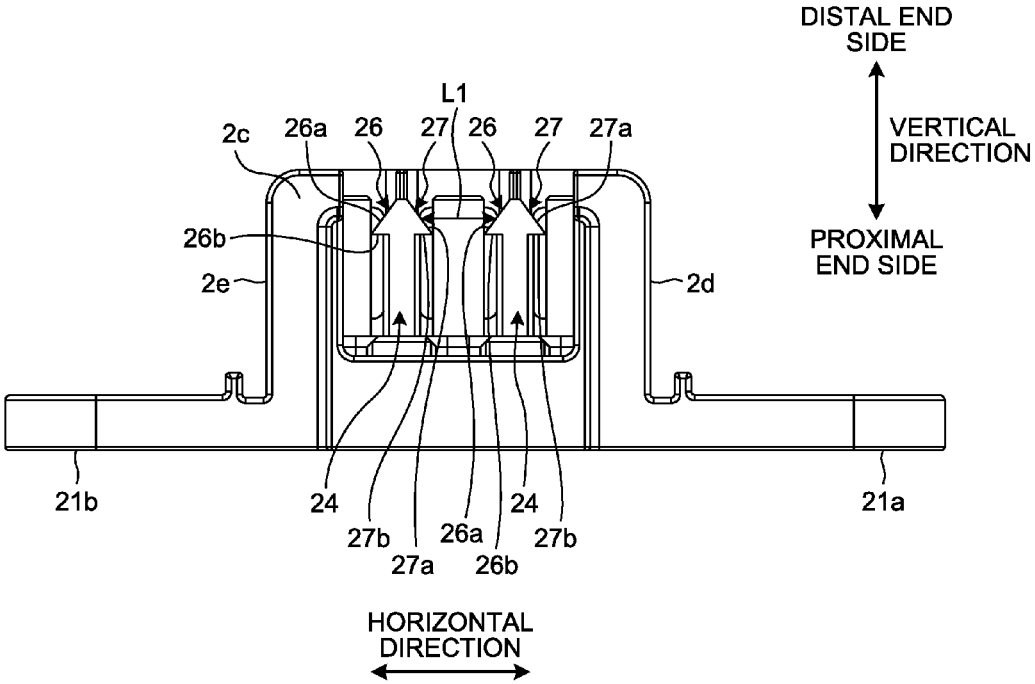
FIG. 6 is a rear view of the connector main body according to the embodiment.
Figure 7:
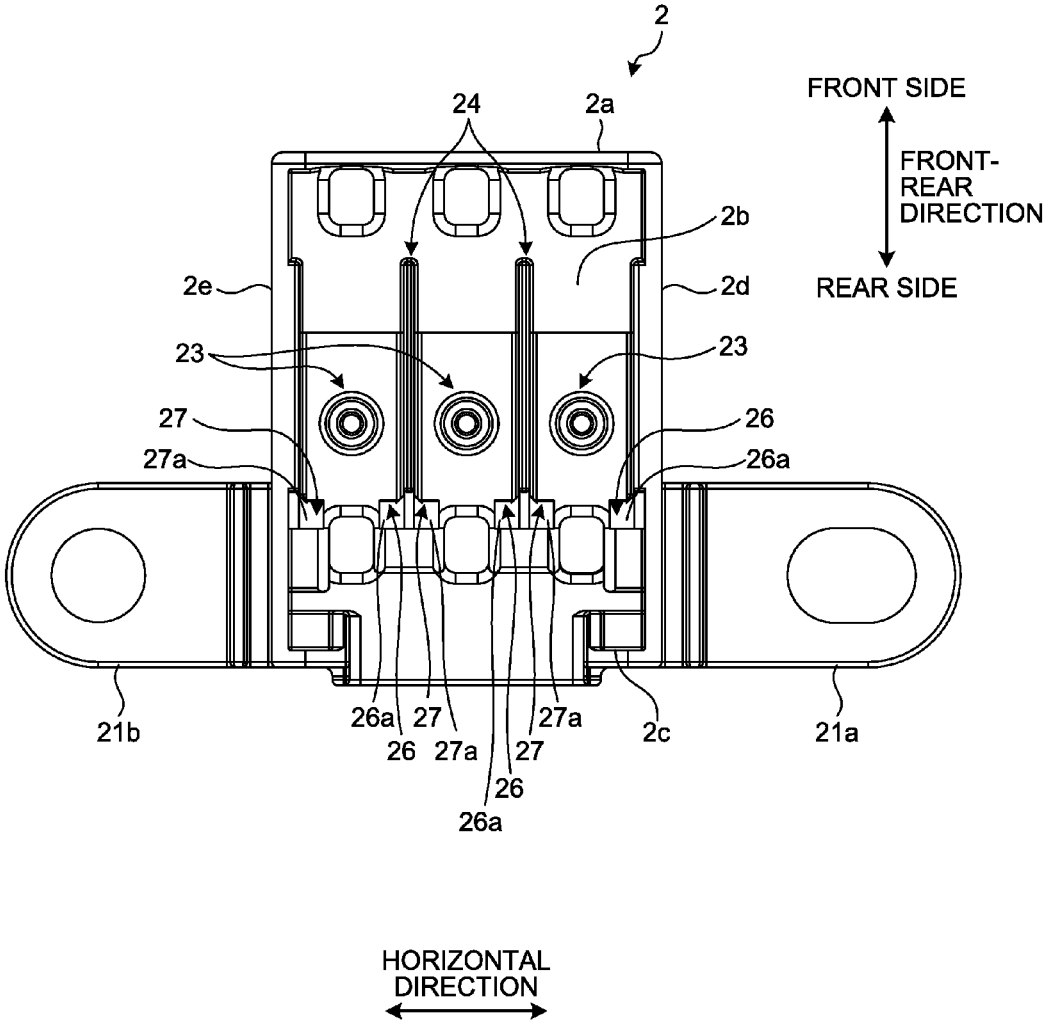
FIG. 7 is a plan view of the connector main body according to the embodiment.

Here, as will be described below, the connector 1 according to the present embodiment has a configuration that improves the efficiency of the assembling work of the torsion spring 7. Specifically, as illustrated in FIGS. 6 and 7, the connector main body 2 has a first guide portion 26 and a second guide portion 27. The first guide portion 26 guides the first arm 7*b* of the torsion spring 7. The second guide portion 27 guides the second arm 7*c* of the torsion spring 7. The first guide portion 26 is provided on the first side wall portion 2*d* side of the connector main body 2 and the second side wall portion 2*e* side of each partition wall portion 24. The first guide portion 26 is a protrusion which protrudes in the horizontal direction from the first side wall portion 2*d* and each partition wall portion 24. The second guide portion 27 is provided on the second side wall portion 2*e* side of the connector main body 2 and the first side wall portion 2*d* side of each partition wall portion 24. The second guide portion 27 is a protrusion which protrudes in the horizontal direction from the second side wall portion 2*e* and each partition wall portion 24. The first guide portion 26 and the second guide portion 27 are each provided at the rear end portion of the partition wall portion 24.

The first guide portion 26 and the second guide portion 27 have inclined guide surfaces 26*a* and 27*a*, respectively. The guide surface 26*a* of the first guide portion 26 is inclined toward the second side wall portion 2*e* in the horizontal direction as it goes toward the proximal end side of the shaft portion 23 in the vertical direction (hereinafter simply referred to as a "proximal end side"). The guide surface 27*a* of the second guide portion 27 is inclined toward the first side wall portion 2*d* as it goes toward the proximal end side in the vertical direction. The guide surface 26*a* and the guide surface 27*a* face each other in the horizontal direction. Therefore, a distance L1 (see FIG. 6) in the horizontal direction between the guide surface 26*a* and the guide surface 27*a* becomes shorter toward the proximal end side in the vertical direction. In other words, an interval between the pair of guide surfaces 26*a* and 27*a* becomes narrower toward the proximal end side in the vertical direction.

As illustrated in FIG. 6, the guide portions 26 and 27 have stopper surfaces 26*b* and 27*b*, respectively. The stopper surfaces 26*b* and 27*b* are surfaces facing the proximal end side in the vertical direction. The stopper surfaces 26*b* and 27*b* are continuous to the end portions of the guide surfaces 26*a* and 27*a* on the proximal end side. That is, a step is formed in the partition wall portion 24 on the proximal end side of the guide surfaces 26*a* and 27*a*. The interval between two adjacent partition wall portions 24 is wider on the proximal end side than the guide surfaces 26*a* and 27*a*.

Figure 8:
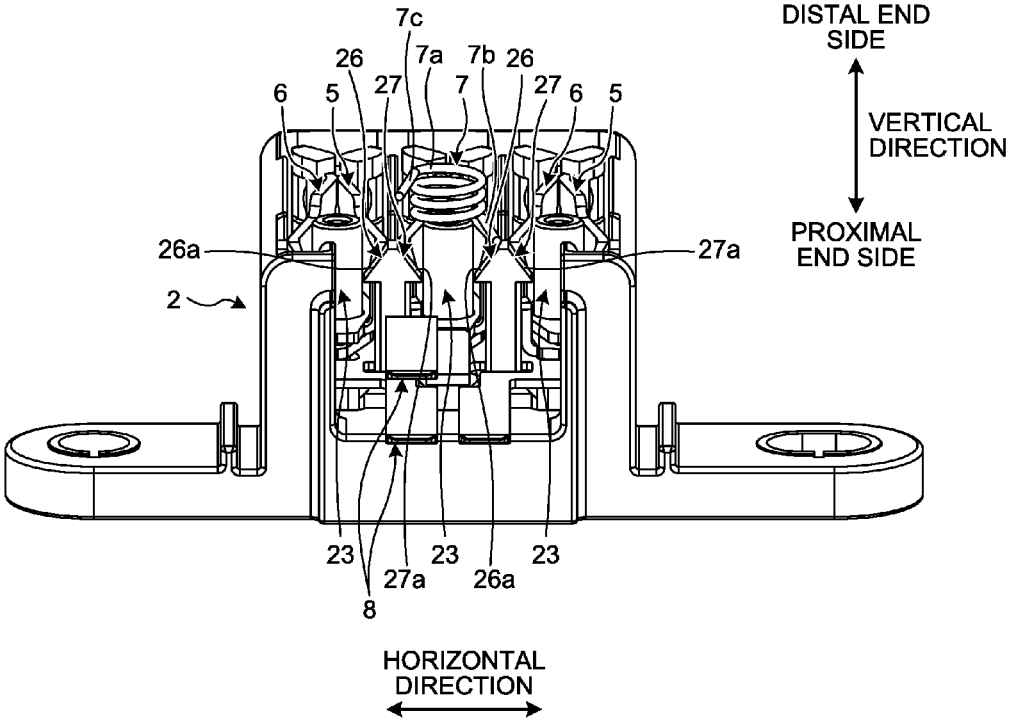
FIG. 8 is a perspective view illustrating a state in which a torsion spring is mounted on the connector of the embodiment.

A method of assembling the torsion spring 7 to the connector main body 2 and the terminals 5 and 6 will be described. FIG. 8 illustrates a state in which the first terminal 5, the second terminal 6, and the bus bar 8 are already assembled to the shaft portion 23 of the connector main body 2. As illustrated in FIG. 8, the torsion spring 7 is placed on the connector main body 2 in a state in which the distal end portion of the shaft portion 23 is inserted into the coil 7*a*. The posture of the torsion spring 7 at this time is a posture in which the arms 7*b* and 7*c* extend rearward from the coil 7*a*. In the torsion spring 7 of the present embodiment, the first arm 7*b* is located on the proximal end side in the vertical direction from the coil 7*a*, and the second arm 7*c* is located on the distal end side in the vertical direction from the coil 7*a*, that is, on the distal end side of the shaft portion 23 in the vertical direction. The torsion spring 7 is placed so that the first arm 7*b* comes into contact with the guide surface 26*a* of the first guide portion 26. When the torsion spring 7 is placed on all the shaft portions 23, all the torsion springs 7 are pushed together toward the proximal end side. In the present embodiment, as will be described below, the torsion spring 7 is pushed together by the case 3.

Figure 9:
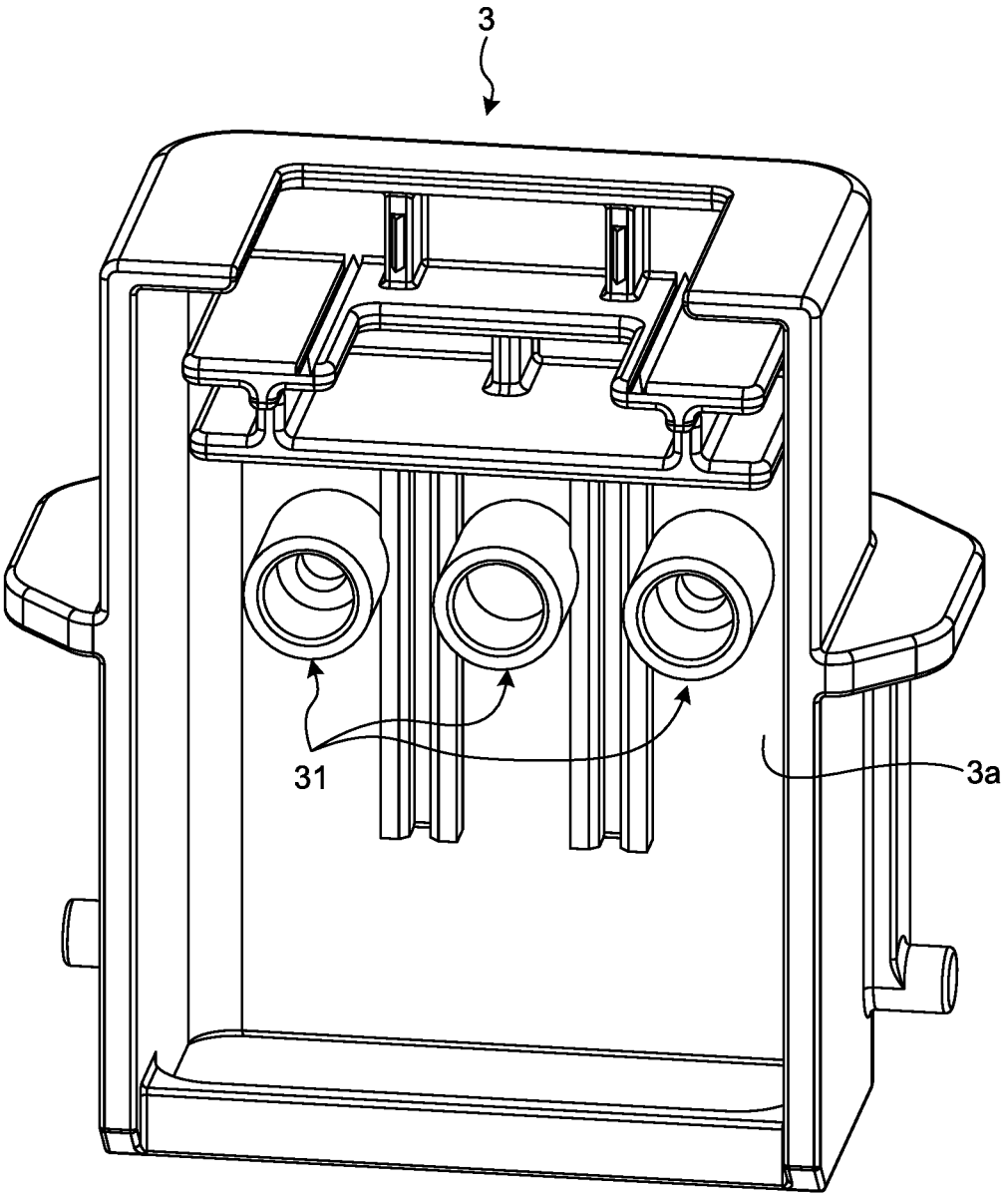
FIG. 9 is a perspective view of a case according to the embodiment.

As illustrated in FIG. 9, the case 3 is provided with pressing portions 31. The pressing portions 31 protrude from a surface 3*a* of the case 3 facing the bottom wall portion 2*b* of the connector main body 2. The shape of the pressing portions 31 of the present embodiment is a cylindrical shape with its distal end open. Three pressing portions 31 are arranged side by side in the horizontal direction. Each of the pressing portions 31 is provided at a position corresponding to the shaft portion 23 of the connector main body 2. The value of the inner diameter of the pressing portion 31 is slightly larger than the value of the outer diameter of the shaft portion 23. That is, the shaft portion 23 can be inserted into the pressing portion 31.

Figure 10:
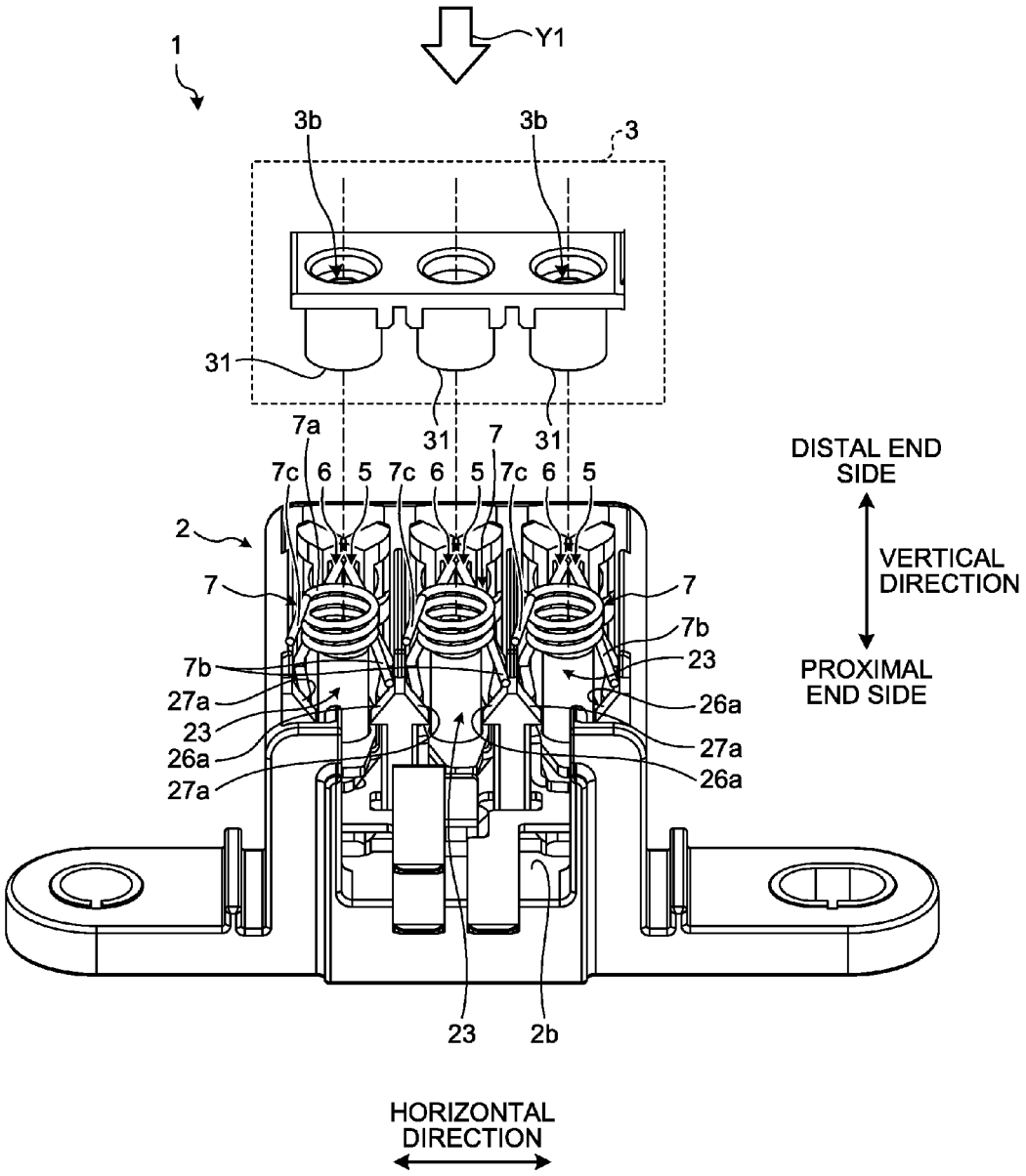
FIG. 10 is a diagram illustrating installation of the torsion spring using a case.

As illustrated by an arrow Y1 in FIG. 10, an assembling operator moves the case 3 toward the connector main body 2, and pushes the torsion spring 7 toward the proximal end side by the pressing portion 31. That is, the case 3 is assembled to the connector main body 2 from the distal end side of the shaft portion 23. The torsion spring 7 pushed by the case 3 moves toward the proximal end side along the shaft portion 23. Due to the movement of the torsion spring 7 toward the proximal end side, the first arm 7*b* abuts against the guide surface 26*a*, and the second arm 7*c* abuts against the guide surface 27*a*. In this state, when the torsion spring 7 further moves toward the proximal end side, and the guide surfaces 26*a* and 27*a* elastically deform the torsion spring 7 so as to bring the first arm 7*b* and the second arm 7*c* close to each other. The torsion spring 7 is elastically deformed in a twisting direction that increases the number of turns of the coil 7*a* by being guided by the guide surfaces 26*a* and 27*a*. The amount of elastic deformation increases as the torsion spring 7 moves toward the proximal end side.

When the torsion spring 7 is further pushed toward the proximal end side by the case 3, the first arm 7*b* passes through the guide surface 26*a*. When the first arm 7*b* enters a region closer to the proximal end side than the guide surface 26*a*, the pressing force generated by the guide surface 26*a* is released. As a result, the first arm 7*b* abuts against the surface of the first terminal 5 on the shaft portion 23 side by the restoring force of the torsion spring 7. Similarly, when the second arm 7*c* moves to the side closer to the proximal end than the guide surface 27*a*, the pressing force generated by the guide surface 27*a* is released. As a result, the second arm 7*c* abuts against the surface of the second terminal 6 on the shaft portion 23 side.

Further, the partition wall portion 24 is formed so as not to prevent the torsion spring 7 from urging the terminals 5 and 6. Specifically, the size of the interval between the adjacent partition wall portions 24 is determined so as not to cause interference with the arms 7*b* and 7*c* in the range on the proximal end side from the guide surfaces 26*a* and 27*a*. Similarly, the size of the interval between the partition wall portion 24 and the first side wall portion 2*d*, and the size of the interval between the partition wall portion 24 and the second side wall portion 2*e* are determined.

As described above, the guide surface 26*a* introduces the first arm 7*b* into the interval between the first terminal 5 and the second terminal 6. Similarly, the guide surface 27*a* introduces the second arm 7*c* into the interval between the first terminal 5 and the second terminal 6. That is, the pair of guide surfaces 26*a* and 27*a* facing each other guides the torsion spring 7 to the interval between the first terminal 5 and the second terminal 6, while torsionally deforming the torsion spring 7.

Figure 11:
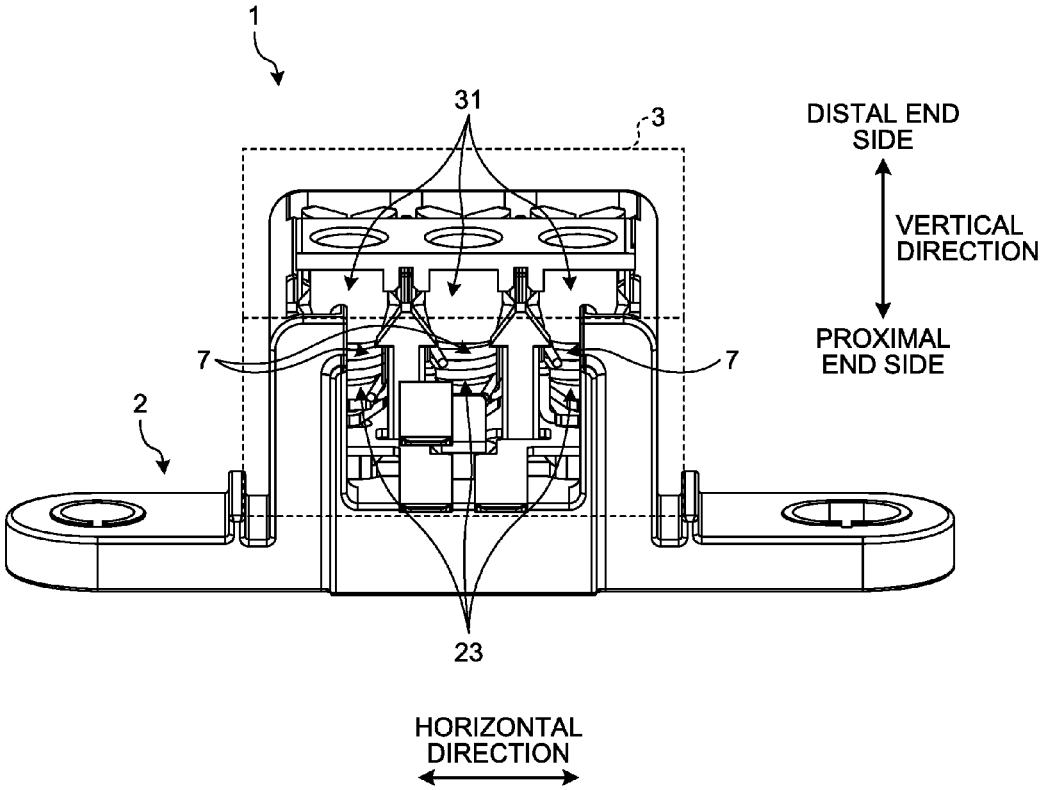
FIG. 11 is a diagram illustrating a state in which the installation of the torsion spring using the case is completed.

The pressing portion 31 of the case 3 is fitted to the shaft portion 23 as illustrated in FIG. 11, while pushing the torsion spring 7 toward the proximal end side. The pressing portion 31 fitted to the shaft portion 23 functions as a stopper which regulates the movement of the torsion spring 7 toward the distal end side. The pressing portion 31 is fitted to the shaft portion 23, and holds the torsion spring 7 between the shaft portion 23 and the bottom wall portion 2*b*. When the pressing portion 31 is fitted to the shaft portion 23, the case 3 is fixed to the connector main body 2 by screws or the like. In this embodiment, a screw hole is formed in the shaft portion 23, and a through-hole 3*b* (see FIG. 10) through which a screw is inserted is formed in the case 3.

Further, in the connector 1 of the present embodiment, the torsion spring 7 may be assembled to the connector main body 2 manually by an operator. For example, the torsion spring 7 placed as illustrated in FIG. 8 may be pushed toward the proximal end side by the hand of the operator. Further, the operator can also push the torsion spring 7 toward the proximal end side, using a jig.

Figure 12:
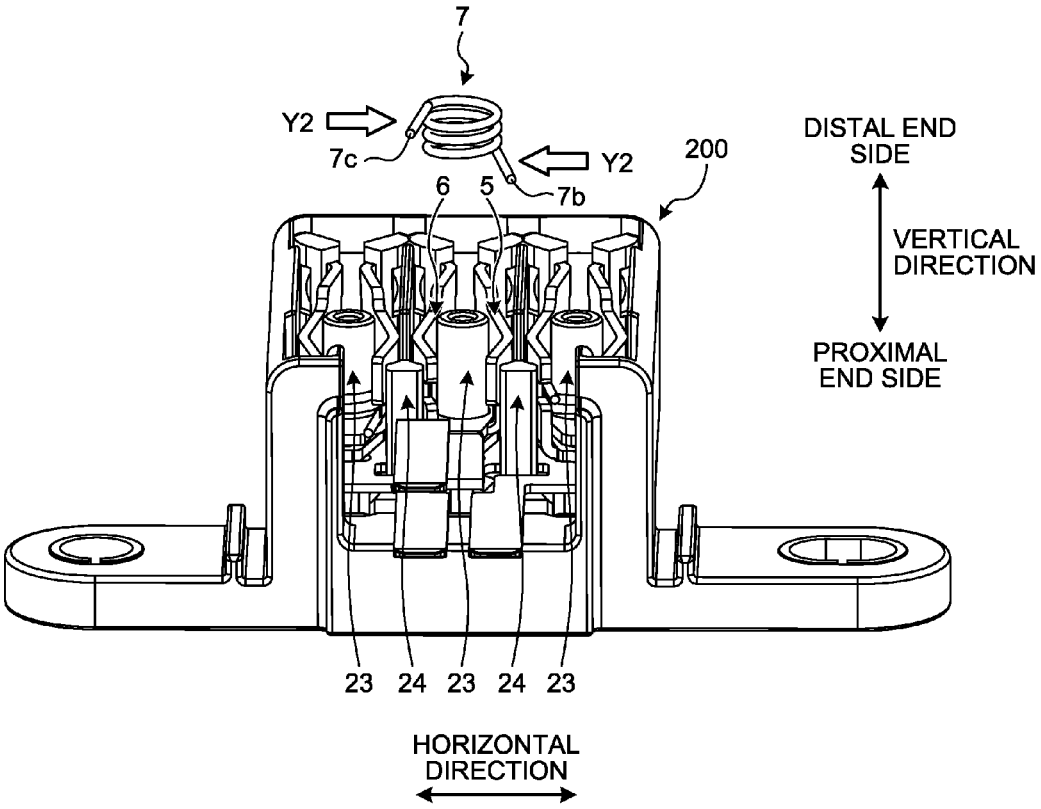
FIG. 12 is a perspective view illustrating a connector main body according to a comparative example.

In the connector 1 of the present embodiment, workability of assembling the torsion spring 7 is improved. FIG. 12 illustrates a connector main body according to a comparative example. The connector main body 200 of the comparative example illustrated in FIG. 12 does not have the guide portions 26 and 27. For this reason, the assembling operator needs to push the torsion spring 7 toward the proximal end side, while applying force to the torsion spring 7 as illustrated by an arrow Y2 to torsionally deform the torsion spring. The assembling work requires complicated operations and thus involves difficulty.

Meanwhile, in the connector 1 of the present embodiment, a force directed toward the proximal end side applied to the torsion spring 7 is converted into a force that torsionally deforms the torsion spring 7 by the guide surfaces 26*a* and 27*a*. Therefore, the operator can assemble the torsion spring 7 to the connector main body 2, only by applying a force in one direction toward the proximal end side. Therefore, it is possible to push a plurality of torsion springs 7 together by the case 3 and to assemble the plurality of torsion springs 7 to the connector main body 2.

Further, even when the operator manually pushes the torsion spring 7, the torsion spring 7 can be assembled only by applying a force in one direction toward the proximal end side. The same also applies to a case where an operator pushes the torsion spring 7, using a jig. When an operator pushes the coil 7*a* of the torsion spring 7 with a hand or a jig, the torsion spring 7 is automatically torsionally deformed by the guide surfaces 26*a* and 27*a*. As a result, since it is not necessary to apply force in different two directions at the same time when assembling, the assembling workability of the torsion spring 7 is improved as compared with the connector main body 200 of the comparative example. Further, since the guide portions 26 and 27 torsionally deform the torsion spring 7, it is possible to prevent the amount of deformation of the torsion spring 7 at the time of assembling from becoming too large.

Further, in the connector 1 of the present embodiment, when the torsion spring 7 is pushed by the case 3, it is possible to more reliably set the torsion spring 7 to a target position in the vertical direction.

Figure 13:
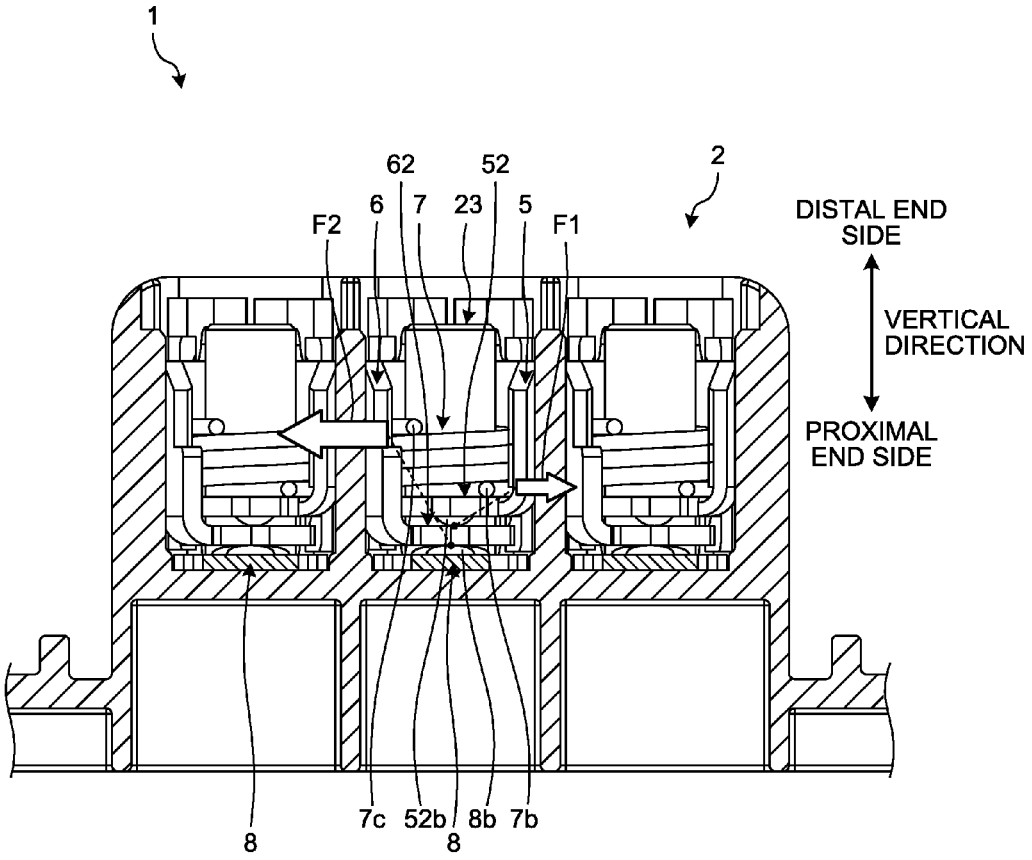
FIG. 13 is a rear view illustrating a tilt suppressing structure according to the embodiment.

Further, the connector 1 of the present embodiment has a configuration capable of suppressing the inclination of the terminals 5 and 6. As illustrated in FIG. 13, the support portion 62 of the second terminal 6 is interposed between the support portion 52 of the first terminal 5 and the bus bar 8. The second terminal 6 receives the urging force F2 from the second arm 7*c* located on the distal end side, among the two arms 7*b* and 7*c* of the torsion spring 7. Meanwhile, the first terminal 5 receives the urging force F1 from the first arm 7*b* located on the proximal end side, among the two arms 7*b* and 7*c*. The urging forces F1 and F2 of the torsion spring 7 generate a moment which tends to tilt the terminals 5 and 6. A moment, which tends to tilt with the contact to the protrusion 8*b* as a fulcrum, acts on the second terminal 6, by the urging force F2 of the second arm 7*c*. A moment, which tends to tilt with the contact between the protrusion 52*b* of the support portion 52 and the support portion 62 as a fulcrum, acts on the first terminal 5, by the urging force F1 of the first arm 7*b*. Large moment acts on the second terminal 6 as the distance in the vertical direction from the fulcrum to the point of application of the urging force F2 increases.

However, in the connector 1 of the present embodiment, the support portion 62 of the second terminal 6 is interposed from both sides in the vertical direction, by the support portion 52 of the first terminal 5 and the bus bar 8. The support portion 52 of the first terminal 5 interposes the support portion 62 between the support portion 52 and the bus bar 8, thereby suppressing the inclination of the second terminal 6. In the first terminal 5, since the distance in the vertical direction from the fulcrum to the point of application of the urging force F1 is short, the moment received is small as compared with the second terminal 6. Therefore, according to the connector 1 of the present embodiment, the inclination of the terminals 5 and 6 is suppressed.

By suppressing the inclination of the terminals 5 and 6, the state of electrical connection between the terminals 5 and 6 and the tab 101 is stabilized.

As described above, the connector 1 of the embodiment has the connector main body 2, the pair of terminals 5 and 6, the torsion spring 7, and the guide portions 26 and 27. The connector main body 2 has the shaft portion 23 which protrudes from the bottom wall portion 2*b* and the bottom wall portion 2*b*. The pair of terminals 5 and 6 is freely rotatable around the shaft portion 23 relative to each other, and interposes the tab 101 of the counterpart connector 100.

The torsion spring 7 has the coil 7*a*, and a pair of arms 7*b* and 7*c*. The arms 7*b* and 7*c* protrude outward in a radial direction from the coil 7*a*. The torsion spring 7 is a torsion spring which is disposed between the pair of terminals 5 and 6 in a state in which the shaft portion 23 is inserted into the coil 7*a* to urge the pair of terminals 5 and 6 in the rotational direction by the pair of the arms 7*b* and 7*c*.

The guide portions 26 and 27 are provided in the connector main body 2. The guide portions 26 and 27 abut against the pair of arms 7*b* and 7*c* when the torsion spring 7 is pushed toward the proximal end side of the shaft portion 23, and the guide portions 26 and 27 guide the torsion spring 7 between the pair of terminals 5 and 6, while elastically deforming the torsion spring 7. In the connector 1 of the present embodiment, since the torsion spring 7 is elastically deformed in the torsion direction by the guide portions 26 and 27, it is possible to improve the assembling workability of the torsion spring 7.

Further, the guide portions 26 and 27 of the present embodiment have a pair of guide surfaces 26*a* and 27*a* which face each other and are inclined. When the torsion spring 7 is pushed toward the proximal end side of the shaft portion 23, the pair of arms 7*b* and 7*c* is guided by abutting against each of the pair of guide surfaces 26*a* and 27*a*. The interval between the pair of guide surfaces 26*a* and 27*a* becomes narrower toward the proximal end side of the shaft portion 23. The torsion spring 7 is smoothly deformed by guiding the arms 7*b* and 7*c* by the guide surfaces 26*a* and 27*a* in which the interval gradually narrows.

A plurality of pairs of terminals 5 and 6 is disposed in the connector main body 2. The connector main body 2 has a partition wall portion 24 that partitions between one pair of terminals 5 and 6 and the other pair of terminals 5 and 6. The guide portions 26 and 27 are protrusions provided on the partition wall portion 24. By providing the guide portions 26 and 27 on the partition wall portion 24, complication of the shape of the connector main body 2 is suppressed.

The connector 1 of the present embodiment further has the case 3 assembled to the connector main body 2 from the distal end side of the shaft portion 23. The case 3 has the pressing portion 31 that abuts against the torsion spring 7 to press the torsion spring 7 toward the proximal end side of the shaft portion 23. The pressing portion 31 functions as a jig which pushes the torsion spring 7 toward the proximal end side when assembling the torsion spring 7. Further, the pressing portion 31 functions as a stopper which suppresses extraction of the torsion spring 7, after being assembled to the connector main body 2.

The pressing portion 31 is fitted to the shaft portion 23 and holds the torsion spring 7 between the shaft portion 23 and the bottom wall portion 2*b*. Therefore, the pressing portion 31 can position the torsion spring 7 and stabilize the operation of the torsion spring 7.

The arrangements, the shapes, and the like of the first guide portion 26 and the second guide portion 27 are not limited to those exemplified in the embodiment. The arrangement and shape of the pressing portion 31 are not limited to those exemplified in the embodiment. The shapes of the terminals 5 and 6 and the torsion spring 7 are not also limited to those exemplified in the embodiment.

Modified Example of Embodiment

The first guide portion 26 and the second guide portion 27 may extend in different ranges in the vertical direction. For example, as illustrated in FIG. 8, the guide portions 26 and 27 may be configured so that, when the torsion spring 7 is placed, the first arm 7*b* not only comes into contact with the guide surface 26*a* of the first guide portion 26, but also the second arm 7*c* abuts against the guide surface 27*a* of the second guide portion 27. In this case, the guide portions 26 and 27 can more stably guide the torsion spring 7.

A modified example of the embodiment will be described. The pressing portion 31 of the case 3 may have a regulator such as a protrusion which regulates a relative rotation of the torsion spring 7 with respect to the pressing portion 31. Such a pressing portion 31 can regulate the rotation of the torsion spring 7 when the torsion spring 7 is assembled to the connector main body 2. Therefore, such a pressing portion 31 can more appropriately bring the arms 7*b* and 7*c* into contact with the guide surfaces 26*a* and 27*a*.

The contents disclosed in the above embodiments and modified examples can be executed in appropriate combination.

A connector according to the embodiments has a guide portion which is provided in a connector main body and abuts against a pair of arms when a torsion spring is pushed toward a proximal end side of a shaft portion, and guides the torsion spring between the pair of terminals, while elastically deforming the torsion spring. According to the connector of the embodiments, the elastic deformation of the torsion spring can be performed by the guide portion, and there is an effect such as simplification of the assembling work of the torsion spring.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a connector main body comprising a wall portion and a shaft portion protruding from the wall portion;

a pair of terminals which is relatively rotatable about the shaft portion and interposes a counterpart terminal;

a torsion spring comprising a coil, and a pair of arms protruding outward in a radial direction from the coil, the torsion spring being disposed between the pair of terminals in a state in which the shaft portion is inserted through the coil, the torsion spring urging the pair of terminals in a rotational direction by the pair of arms; and a guide portion which is provided in the connector main body, the guide portion abutting against the pair of arms when the torsion spring is pushed toward a proximal end side of the shaft portion, the guide portion guiding the torsion spring between the pair of terminals while elastically deforming the torsion spring, wherein a plurality of the pairs of terminals is disposed on the connector main body, the connector main body further comprises a partition wall portion which partitions between one pair of the plurality of the pairs of terminals and another pair of the plurality of the pairs of the terminals, and the guide portion is a protrusion provided on the partition wall portion.

2. The connector according to claim 1, wherein the guide portion comprises a pair of guide surfaces which faces each other and is inclined, when the torsion spring is pushed toward the proximal end side of the shaft portion, the pair of arms is guided by abutting against each of the pair of guide surfaces, and an interval between the pair of guide surfaces becomes narrower toward the proximal end side of the shaft portion.

3. The connector according to claim 1, further comprising:

a case assembled to the connector main body from a distal end side of the shaft portion, wherein the case comprises a pressing portion which abuts against the torsion spring to press the torsion spring toward the proximal end side of the shaft portion.

4. The connector according to claim 3, wherein the pressing portion is fitted to the shaft portion, and holds the torsion spring between the pressing portion and the wall portion.

5. The connector according to claim 2, further comprising:

a case assembled to the connector main body from a distal end side of the shaft portion, wherein the case comprises a pressing portion which abuts against the torsion spring to press the torsion spring toward the proximal end side of the shaft portion.

6. The connector according to claim 5, wherein the pressing portion is fitted to the shaft portion, and holds the torsion spring between the pressing portion and the wall portion.

7. The connector according to claim 1, further comprising:

a case assembled to the connector main body from a distal end side of the shaft portion, wherein the case comprises a pressing portion which abuts against the torsion spring to press the torsion spring toward the proximal end side of the shaft portion.

8. The connector according to claim 7, wherein the pressing portion is fitted to the shaft portion, and holds the torsion spring between the pressing portion and the wall portion.

* * * * *